US005685624A

United States Patent [19]

Lee

[11] Patent Number: 5,685,624

[45] Date of Patent: Nov. 11, 1997

[54] DOOR FOR A REFRIGERATOR HAVING ROTATABLE POCKETS

[75] Inventor: Sang-Moo Lee, Incheon, Rep. of Korea

[73] Assignee: Daewoo Electronics Co., Ltd., Seoul, Rep. of Korea

[21] Appl. No.: 692,128

[22] Filed: Aug. 5, 1996

[30] Foreign Application Priority Data

Aug. 4, 1995 [KR] Rep. of Korea ..... 95-24164

[51] Int. Cl.[6] ..... A47B 96/04

[52] U.S. Cl. ..... 312/405.1; 312/408; 312/298; 312/274; 312/321.5; 62/377

[58] Field of Search ..... 312/405.1, 405, 312/408, 300, 401, 298, 274, 302, 321.5; 62/377

[56] References Cited

U.S. PATENT DOCUMENTS

| | | | |
|---|---|---|---|
| 2,074,785 | 3/1937 | Gentz | 312/300 X |
| 2,104,939 | 1/1938 | Whalen | 312/300 X |
| 2,266,857 | 12/1941 | Field | 312/300 X |
| 2,976,101 | 3/1961 | Rooney | 312/300 |
| 3,172,715 | 3/1965 | Powder | 312/298 |
| 3,550,982 | 12/1970 | Zaidan | 312/302 |
| 4,186,978 | 2/1980 | Thomson | 312/300 X |
| 5,193,892 | 3/1993 | Swindell | 312/405.1 X |
| 5,513,910 | 5/1996 | Ellingwood et al. | 312/298 X |

*Primary Examiner*—Peter M. Cuomo
*Assistant Examiner*—James O. Hansen
*Attorney, Agent, or Firm*—Beveridge, DeGrandi, Weilacher & Young LLP

[57] ABSTRACT

A door for a refrigerator having rotatable pockets is provided, which includes a pair of hinge bar installation parts formed in the upper and lower portions on the inner side of a first side-wall of the door with a predetermined distance; a hinge bar installed between the pair of hinge bar installation parts and in parallel with the first side-wall along its length direction; a plurality of pocket shelves each protruded out of the inner side of the door and having one hole into which the hinge bar can be inserted; a plurality of pockets each placed between the pair of hinge bar installation parts, having a hinge bar insertion hole into which each hinge bar is inserted to move about the hinge bar, being supported by the plurality of pocket shelves, and having a fixing pit; and a plurality of protrusions formed on a second side-wall of the door to be engaged/released with/from the fixing pit when each of the plurality of pockets is closed/opened.

4 Claims, 3 Drawing Sheets

DOOR FOR A REFRIGERATOR HAVING ROTATABLE POCKETS

BACKGROUND OF THE INVENTION

1. Field of the Invention

The present invention relates to a refrigerator, and more particularly to a door for a refrigerator having rotatable pockets.

2. Description of the Prior Art

FIG. 1 is a perspective view for showing a door for conventional refrigerator having pockets. As illustrated in FIG. 1, in general, pockets 14 are provided on the inner side of the door 10 for the refrigerator. The pockets 14 accommodate a bottle, a can or other stuff, respectively. Each of the pockets 14 has a base plate 14*c*, a guide wall 14*a* and a connection pit 14*b*. The base plate 14*c* has four sides. The base plate 14*c* supports the bottom of the accommodated stuff in each of the pockets 14. Accordingly, contained the accommodated stuff does not drop out of the pockets 14. The guide wall 14*a* has a first side-wall 14*d* and a second side-wall 14*e*. The first side-wall 14*d* is formed oppositely with the second side-wall 14*e*. The first and second side-walls 14*d* and 14*e* are installed detachably inside the first and second side-walls 11*a* and 11*b* of the door 10. The connection pit 14*b* is formed on each of the first and second side-walls 14*d* and 14*e* (the other connection pit is not shown). A connection protrusion 12 is formed on each of the first and second side-walls 11*a* and 11*b* of the door 10. When the pockets 14 are inserted between the first and second side-walls 11*a* and 11*b*, the pockets 14 are inserted between the first and second side-walls 11*a* and 11*b* in order that the connection pits 14*b* of the pockets 14 may be engaged with the connection protrusions 12 of the first and second side-walls 11*a* and 11*b*.

As illustrated in FIG. 1, in case of engaging the connection pits 14*b* with the connection protrusions 12, each of the pockets 14 is inserted from up to down between the first and second side-wall 11*a* and 11*b*. In case of releasing the connection pits 14*b* from the connection protrusions 12, each of the pockets 14 is lifted from down to up.

Meanwhile, a pocket shelf 13 is installed on the inner surface of the door 10. The pocket shelf 13 supports the bottom of the base plate 14*c* of each of the pockets 14. Accordingly, each of the pockets 14 connected with the connection protrusions 12 is supported by the pocket shelf 13. The pockets 14 are in rows installed with a predetermined distance from each other.

In installing the above-mentioned conventional pockets, specifically when putting/taking the stuff into/out of the pockets, the upper portion of the stuff in a pocket gets interfered by the lower edge portion of another pocket installed just over the pocket. And this kind of interference also gives damages to the guide wall.

SUMMARY OF THE INVENTION

Accordingly, the present invention is directed to a door for a refrigerator having rotatable pockets that substantially obviates one or more of the problems due to limitations and disadvantages of the related art.

An object of the present invention is to provide a door for a refrigerator having the rotatable pockets, which includes a pair of hinge bar installation parts each protruded from upper and lower portions of the inner side of a first side-wall of the door with a predetermined distance therebetween; a hinge bar installed between the pair of hinge bar installation parts with both ends of the hinge bar engaged with the pair of hinge bar installation parts and in parallel with the inner side of the first side-wall in its length direction; a plurality of pocket shelves each protruded out of the inner side of the door and having one hole on one side portion into which the hinge bar can be inserted; a plurality of pockets each placed between the pair of hinge bar installation parts, having a hinge bar insertion hole into which the hinge bar is inserted, and having a fixing pit, and for each hingedly rotating about the hinge bar and being supported by the plurality of pocket shelves respectively; and a protrusion lengthwisely formed along the edge portion of the inner side of a second side-wall of the door, wherein the fixing pit is engaged/released with/from the protrusion when each of the plurality of pockets is closed/opened.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the drawings, in which.

DETAILED DESCRIPTION OF PREFERRED EMBODIMENT

Reference will now be made in detail to the preferred embodiments of the present invention, and examples which are illustrated in the accompanying drawings.

Figure 1:
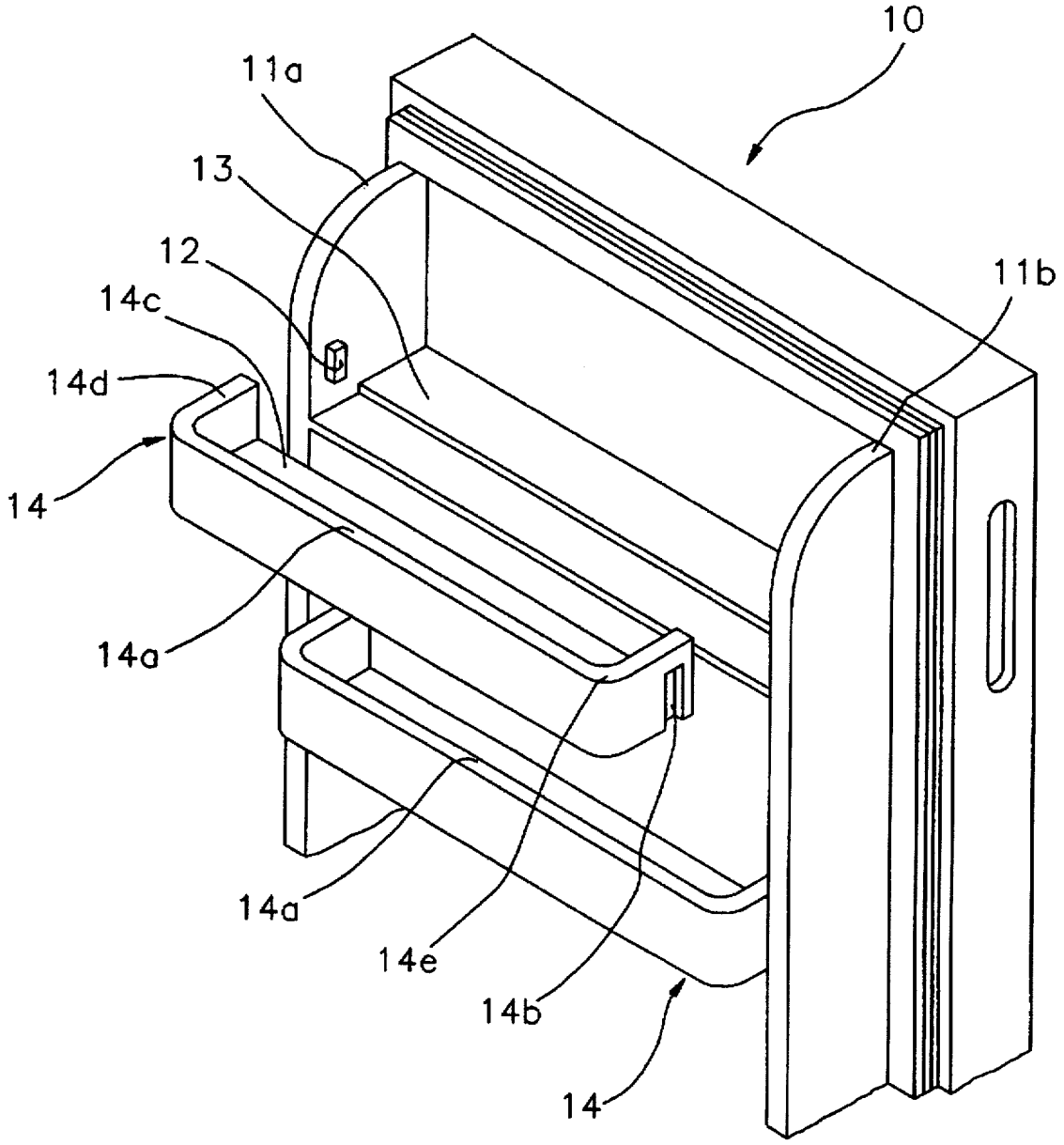
FIG. 1 PRIOR ART
FIG. 1 is a perspective view for showing a conventional door for a refrigerator having pockets.
Figure 2:
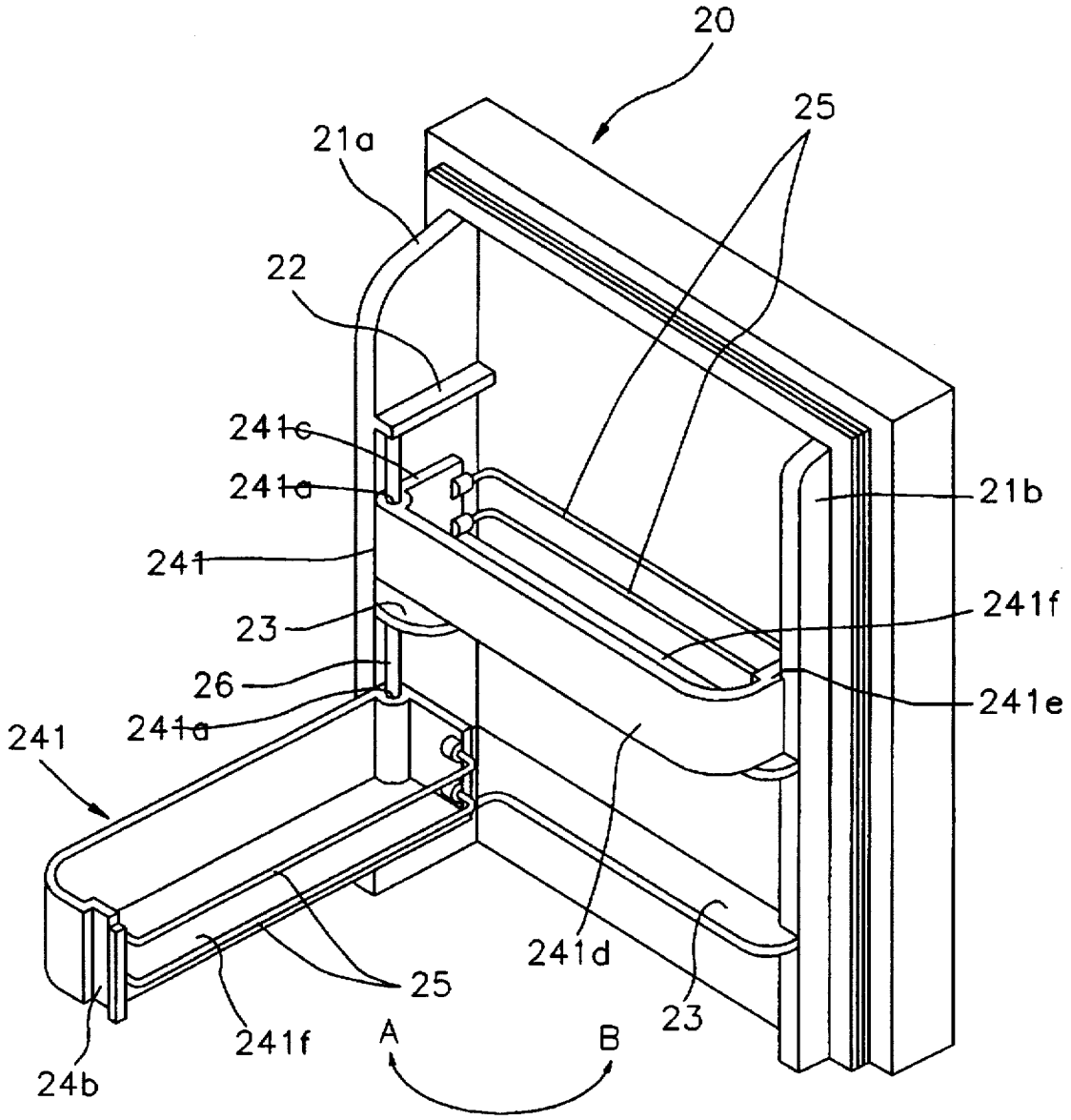
FIG. 2 is a perspective view for showing a door for a refrigerator having rotatable pockets according to one embodiment of the present invention.
Figure 3:
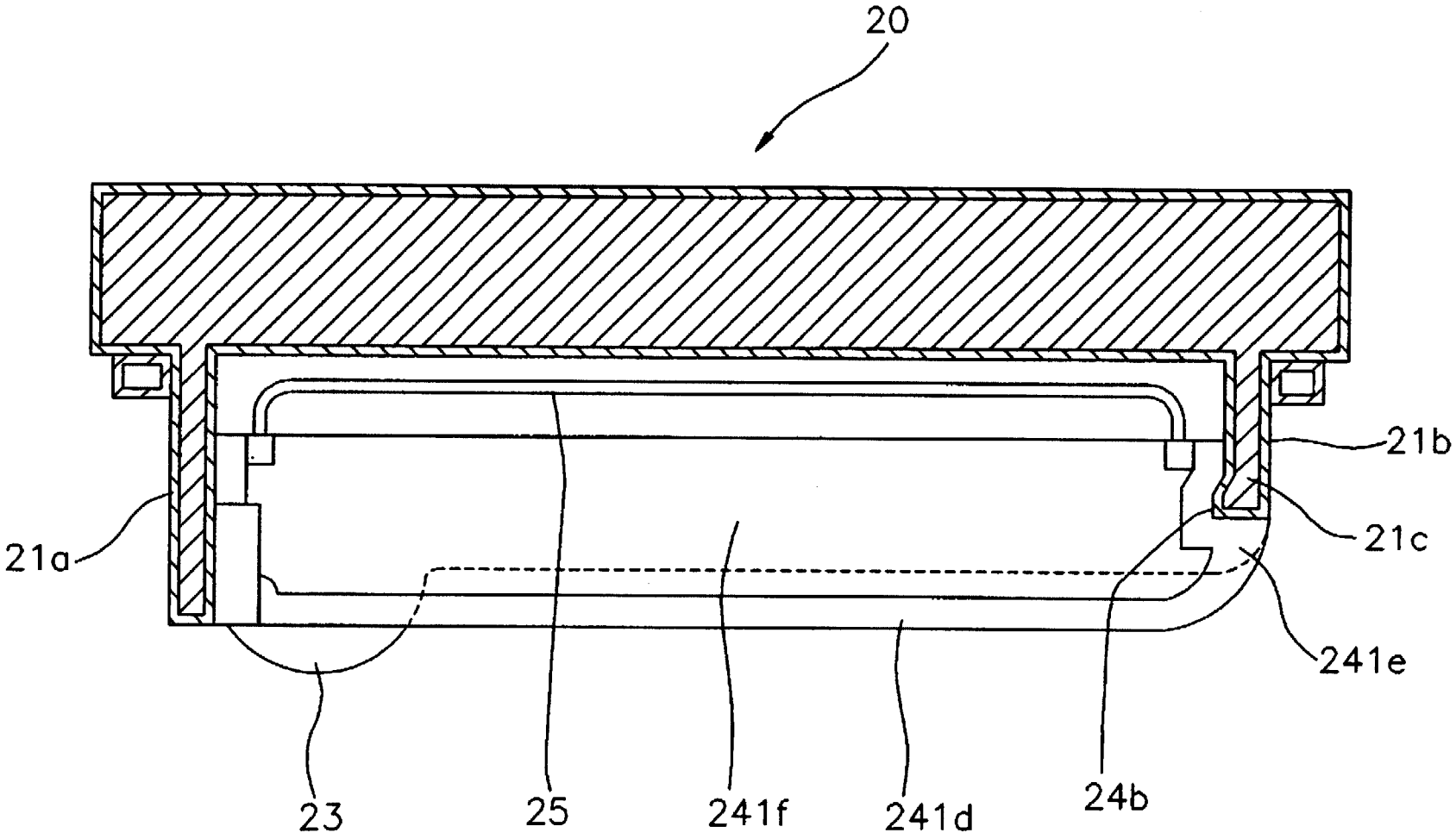
FIG. 3 is a view for illustrating a connection state of one of the pockets of FIG. 2 with the side wall of the door.

As illustrated in FIGS. 2 and 3, a hinge bar 26 is vertically installed on a first side-wall 21*a* of a door 20. A hinge bar insertion hole 241*a* is formed on one side of a pocket 241. The hinge bar 26 is inserted into the hinge bar insertion hole 241*a*. Accordingly, the pocket 241 is rotatably mounted about the hinge bar 26. A pair of hinge bar installation parts 22 are formed on the upper and lower portions of the first side-wall 21*a* of the door 20, protruding inwardly with a predetermined distance therebetween (The lower hinge bar installation part is not shown, but the same as the upper hinge bar installation part.). Each of the hinge bar installation parts 22 has an insertion grooves on one side portion thereof. The insertion grooves (both not shown) of the hinge bar installation parts 22 face correspondingly with each other. One end of the hinge bar 26 is inserted into the insertion groove of the upper hinge bar insertion part 22. The other end of the hinge bar 26 is inserted into the insertion groove of the lower hinge bar insertion part 22. The hinge bar 26 is mounted in parallel with the first side-wall 21*a* along the lengthwise direction of the first side-wall 21*a*.

Each pocket 241 has a first side plate 241*c*, a second side plate 241*d*, a third side plate 241*e*, a base plate 241*f*, and a plurality of guide bars 25. The first, second and third side plates 241*c*, 241*d* and 241*e* are formed to upwardly protrude from the base plate 241*f*. The first side plate 241*c* are disposed oppositely with the third side plate 241*c*. One end of the first side plate 241*c* is connected with one end of the second side plate 241*d* and one end of the third side plate 241*e* is connected with the other end of the second side plate 241*d*. The second side plate 241*d* is disposed oppositely with the plurality of guide bars 25. The hinge bar insertion hole 241*a* is formed through the connection portion of the first side plate 241*c* and the second side plate 241*d*. A fixing pit 24*b* is formed on the third side plate 241*e*.

Respective pockets 241 are hingedly mounted between the pair of hinge bar installation parts 22 with the hinge bar 26 inserted into the hinge bar insertion hole 241*a*.

The fixing pit 24*b* of the pocket 241 is formed along the lengthwise direction of the third side plate 241*e*. The plurality of guide bars 25 are installed oppositely with the second side plate 241*d*. Ends of the plurality of guide bars 25 are connected with the other end of the first side plate 241*c* and the other ends of the plurality of guide bars 25 are connected with the other end of the third side plate 241*e*. The plurality of guide bars 25, which may be two or more guide bars, are installed in rows on the upper and lower edge portions of the first and third side plates 241*c* and 241*e*. The plurality of guide bars 25 prevent the stored stuff from dropping out of the pocket 241. The fixing pit 24*b* is detachably engaged with the inner side of the second side-wall 21*b*. The second side-wall 21*b* is disposed oppositely with the first side-wall 21*a*. That is, a protrusion 21*c* is lengthwisely formed along the edge portion of the inner side of the second side-wall 21*b*. The protrusion 21*c* is inserted into the fixing pit 24*b* so that the pocket 241 is engaged with the second side-wall 21*b*. The pocket 241 is made of an elastic material.

Additionally, two pocket shelves 23 are formed on the inner surface of the door 20. Each of the pocket shelves 23 is placed between the pair of hinge bar installation parts 22. Each of the pocket shelves 23 has one hole on one side portion into which the hinge bar 26 is inserted. The pocket shelves 23 protrude out of the inner surface of the door 20, so that the pocket shelves 23 support the base plates of the pockets 241, respectively.

An operation of the rotatable pocket according to the embodiment of the invention will be described below.

If one end of the pocket 241 is pulled forward (an arrow direction of A of FIG. 2), the fixing pit 24*b* of the pocket 241 releases the engagement of the protrusion 21*c* with the second side-wall 21*b*. Therefore, the pocket 241 becomes rotatable in a forward direction about the hinge bar 26.

When the pocket 241 is properly rotated forwards, stuff such as a can or a bottle can be put in the pocket 241. If the pocket 241 is pushed backwards (an arrow direction of B in FIG. 2), the pocket 241 rotates backwards about the hinge bar 26 so that the fixing pit 24*b* is engaged with the protrusion 21*c*. In addition, when taking out the can or bottle accommodated in the pocket 241, it is the same as described above, that is, the pocket 241 is properly rotated forwards to make it easy to take out the can or bottle.

As described above, when putting in and taking out the stuff such as a can and a bottle by rotating the pocket, the adjacent pocket which is installed just over a pocket is prevented from being damaged due to interference of the can or bottle in the pocket. Moreover, putting and taking the stuff in and out of the pocket is made easy.

It will be apparent to those skilled in the art that various modifications and variations can be made in the door for a refrigerator having rotatable pockets of the present invention without departing from the spirit or scope of the invention. Thus, it is intended that the present invention cover the modifications and variations of this invention provided they come within the scope of the appended claims and their equivalents.

What is claimed is:

1. A door for a refrigerator having pockets for accommodating stuff, comprising:

a pair of hinge bar installation parts each protruded from upper and lower portions of an inner side of a first side-wall of the door with a predetermined distance therebetween;

a hinge bar installed between said pair of hinge bar installation parts with both ends of said hinge bar engaged with said pair of hinge bar installation parts and in parallel with said inner side of said first side-wall;

a plurality of pocket shelves each protruded out of the inner side of said door and having one hole on one portion of the inner side into which said hinge bar can be inserted;

a plurality of pockets each placed between said pair of hinge bar installation parts, having a hinge bar insertion hole into which said hinge bar is inserted, and having a fixing pit, and each of said pockets hingedly rotating about said hinge bar and being supported by said plurality of pocket shelves respectively; and a protrusion lengthwisely formed along an edge portion of an inner side of a second side-wall of said door, wherein said fixing pit is engaged/released with/from said protrusion when each of said plurality of pockets is closed/opened.

2. The door as claimed in claim 1, wherein said pair of hinge bar installation parts have an insertion groove respectively in order for the both ends of said hinge bar to be inserted thereinto.

3. The door as claimed in claim 1, wherein said plurality of pockets respectively comprise a first side plate, a second side plate, a third side plate, a base plate and a plurality of guide bars, said first, second and third side plates being upwardly protruded along a portion of the periphery of said base plate, one end of said first side plate being connected with one end of said second side plate forming a connection portion, and one end of said third side plate being connected with the other end of said second side plate in which said first side plate and third side plate are opposite with each other, one end of each of said plurality of guide bars being connected with the other end of said first side plate and the other end of each of said plurality of guide bars being connected with the other end of said third side plate so that said plurality of guide bars are opposite to said second side plate, said hinge bar insertion hole being formed in the connection portion of said first side plate and second side plate in order for said hinge bar to be inserted therethrough so that said plurality of pockets hingedly rotates, said fixing pit being formed in said third side plate to be engaged with said protrusion.

4. The door as claimed in claim 3, wherein said first, second, and third side plates of each of said plurality of pockets are made of elastic material.

* * * * *